US012123164B2

(12) United States Patent
Kuehn et al.

(10) Patent No.: US 12,123,164 B2
(45) Date of Patent: Oct. 22, 2024

(54) MOTOR GRADER BLADE WITH ABILITY TO FOLLOW FRONT TIRES

(71) Applicant: Caterpillar Inc., Peoria, IL (US)

(72) Inventors: Jeffrey L. Kuehn, Germantown Hills, IL (US); Vincent D. Jones, Chillicothe, IL (US); Joshua T. Hayes, Table Grove, IL (US); Michael Hill, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 829 days.

(21) Appl. No.: 17/321,833

(22) Filed: May 17, 2021

(65) Prior Publication Data

US 2022/0364324 A1 Nov. 17, 2022

(51) Int. Cl.

| | |
|---|---|
| ***E02F 3/84*** | (2006.01) |
| ***E02F 3/76*** | (2006.01) |
| ***E02F 9/20*** | (2006.01) |

(52) U.S. Cl.

CPC ..... *E02F 3/841* (2013.01); *E02F 3/764* (2013.01); *E02F 3/7645* (2013.01); *E02F 3/765* (2013.01); *E02F 3/844* (2013.01); *E02F 9/2087* (2013.01)

(58) Field of Classification Search

CPC ..... E02F 3/764; E02F 3/7645; E02F 3/765; E02F 3/7654; E02F 3/841; E02F 3/844; E02F 9/2087; E02F 9/225

See application file for complete search history.

(56) References Cited

U.S. PATENT DOCUMENTS

| | | | | |
|---|---|---|---|---|
| 6,028,524 | A | 2/2000 | Hartman et al. | |
| 6,152,237 | A * | 11/2000 | Hartman | E02F 3/842 172/1 |
| 6,282,453 | B1 | 8/2001 | Lombardi | |
| 7,676,967 | B2 | 3/2010 | Gharsalli et al. | |
| 8,985,233 | B2 * | 3/2015 | Padilla | E02F 3/7645 172/795 |
| 11,274,421 | B2 * | 3/2022 | Sharma | E02F 3/7636 |
| 2014/0326471 | A1 | 11/2014 | Zhu | |
| 2016/0138249 | A1 | 5/2016 | Conway et al. | |

FOREIGN PATENT DOCUMENTS

| | | | |
|---|---|---|---|
| EP | 0501616 | A2 | 9/1992 |
| EP | 1118719 | A2 | 7/2001 |
| JP | H11181821 | A | 7/1999 |

OTHER PUBLICATIONS

Written Opinion and International Search Report for Int'l. Patent Appln. No. PCT/US2022/028018, mailed Sep. 20, 2022 (11 pgs).

* cited by examiner

*Primary Examiner* — Gary S Hartmann

(57) ABSTRACT

A blade positioning system for a work machine. The system may have a blade control which has a blade position sensor, and the blade control may adjust a blade of the work machine to a fixed position relative to a wheel. The system may also have a steering control that has a wheel position sensor, and the steering control may steer the work machine. The controller may monitor the blade position sensor and the wheel position sensor to determine a present position of the blade and the wheel prior to the repositioning of the wheel, and adjust the blade position as the wheel is repositioned to maintain the fixed position of the blade relative to the wheel.

20 Claims, 5 Drawing Sheets

MOTOR GRADER BLADE WITH ABILITY TO FOLLOW FRONT TIRES

TECHNICAL FIELD

The present disclosure generally relates to a work machine and, more particularly, relates to a blade positioning system for a work machine.

BACKGROUND

Motor graders are used primarily as a finishing tool to sculpt a surface of earth to a final arrangement. Typically, motor graders include many hand-operated controls to steer the wheels of the grader, position the blade, and articulate the front frame of the grader. The blade is adjustably mounted to the front frame to move relatively small quantities of earth from side to side. The articulation angle is adjusted by rotating the front frame of the grader relative to the rear frame of the grader.

To produce a variety of final earth arrangements, the blade and the frame may be adjusted to many different positions. While grading, the operator often places the leading edge of the blade behind the front tire, and often, it is desired to get the blade as close as possible to the front tire in order to obtain the most desirable grade cut; however, as the operator steers the front tires, the blade can come into contact with the tire resulting in damage to the tire.

U.S. Pat. No. 6,028,524 describes a system and method for monitoring the position of a motor grader blade relative to a motor grader frame. The method includes predicting an intersection of a future blade position and a future frame position, and producing an action to prevent the intersection of the future blade position and the future frame position.

While effective, there remains a need for improved blade positioning systems for work machines used in high wear applications, such as construction and mining.

SUMMARY

In accordance with one aspect of the present disclosure, a blade repositioning system for a work machine is disclosed. The system may have a blade control which has a blade position sensor, and the blade control may adjust a blade of the work machine to a fixed position relative to a wheel. The system may also have a steering control that has a wheel position sensor, and the steering control may steer the work machine. The controller may also monitor the blade position sensor and the wheel position sensor to determine a present position of the blade and the wheel prior to the repositioning of the wheel, and adjust the blade position as the wheel is repositioned to maintain the fixed position of the blade relative to the wheel.

In accordance with another aspect of the present disclosure, a work machine is disclosed. The work machine has a rear frame supported on a right and left tandem set of rear wheels, a front frame supported on a pair of front wheels, a steer control, a circle, a controller, and a blade control. The steering control has a front wheels position sensor(s) and is used to steer the work machine by sending a front wheels movement signal to the controller, and the controller then repositioning the front wheels. The circle supports the blade. The blade control also has a blade position sensor and is used to adjust the blade to a fixed position relative to a reference wheel, the reference wheel may be one of the front wheels. The control may monitor the blade position sensor and the front wheels position sensor to determine a present position of the blade and the reference wheel prior to the repositioning of the front wheels, calculate a future reference wheel position based on the received front wheel movement signal, and adjust the blade position as the front wheels are repositioned to maintain the fixed position of the blade relative to the reference wheel.

In accordance with a further aspect of the present disclosure, a method of autonomously repositioning a blade of a work machine relative to a wheel is disclosed. The method may include providing a blade control having a blade position sensor, a steering control having a wheel position sensor, and a controller. The steering control steers the work machine by sending a wheel movement signal to the controller prior to the controller repositioning the wheel. The method may further include adjusting the blade using the blade control to a fixed position relative to the wheel, and monitoring an output of the position sensors to ascertain a present position of the blade and the wheel. The controller then receives the wheel movement signal requesting repositioning of the wheel, calculates a future wheel position based on the received wheel movement signal, and adjust the blade position as the wheel is repositioned to maintain the fixed position of the blade relative to the wheel.

These and other aspects and features of the present disclosure will be more readily understood when read in conjunction with the accompanying drawings.

DETAILED DESCRIPTION

Figure 1:
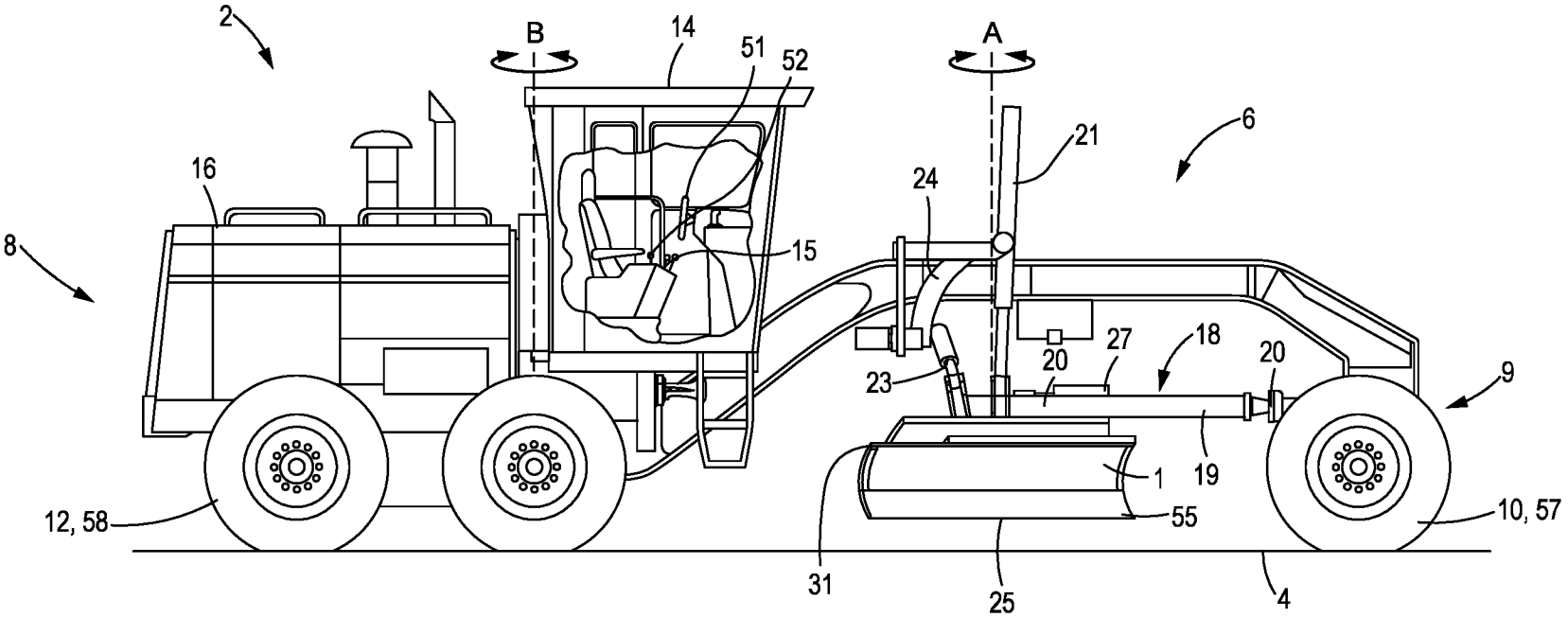
FIG. 1 is a side view of an exemplary work machine having a blade, in accordance with the present disclosure.
Figure 2:
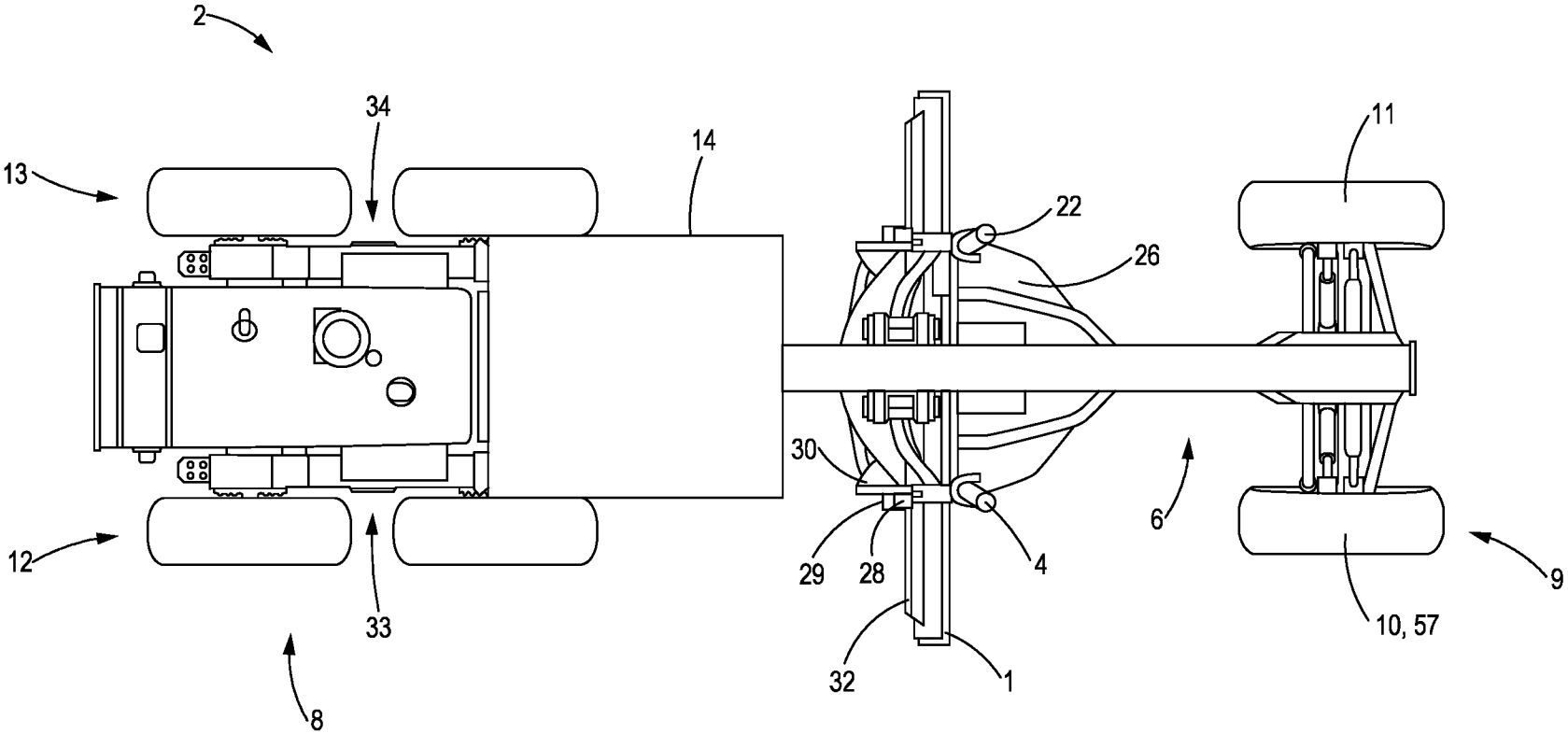
FIG. 2 is a top view of the exemplary work machine of FIG. 1, in accordance with the present disclosure.

Referring to FIGS. 1 and 2, a blade 1, sometimes referred to as a moldboard, is attached to a work machine 2. The work machine 2 may embody a fixed or mobile machine that performs some type of operation associated with an industry such as mining, construction, farming, transportation, or any other industry known in the art. For example, the work machine 2 may be an earth moving machine such as a motor grader, as shown, or a backhoe, an excavator, a dozer, a loader, or any other earth moving machine. The work machine 2 may be used primarily as a finishing tool to sculpt the surface of a ground surface 4 to a final arrangement. Rather than moving large quantities of earth in the direction of travel like other machines, the work machine 2 typically moves relatively small quantities of earth from side to side. In other words, the work machine 2 typically moves earth across the area being graded.

The work machine includes a front frame 6 and a rear frame 8. The front frame 6 is supported on a pair of front wheels 9, or tires, which includes the front right wheel 10 and the front left wheel 11. The rear frame 8 is supported on right and left tandem set of rear wheels 12, 13. An operator cab 14 containing many of the controls 15 necessary to operate the work machine 2 is mounted on the front frame 6. An engine 16 is used to drive or power the work machine 2, and is mounted on the rear frame 8. The blade 1 is used to move earth and is mounted on a linkage assembly 18. The linkage assembly 18 allows the blade 1 to be moved in a variety of different positions relative to the work machine 2.

The linkage assembly further includes a drawbar 19 that is mounted to the front frame 6 with a ball joint 20. The position of the drawbar 19 may be controlled by hydraulic cylinders, commonly referred to as a right lift cylinder 21, a left lift cylinder 22, and a center shift cylinder 23. A coupling 24 connects the three cylinders 21, 22, 23 to the front frame 6. The coupling 24 can be moved during blade 1 repositioning. The height of the blade 1 with respect to the ground surface 4 below the work machine 2, commonly referred to as blade height, is controlled primarily with the right and left lift cylinders 21, 22. The right and left lift cylinder 21, 22 can be controlled independently and, thus, used to control an oscillation angle (not shown) between each side of the blade 1 relative to the ground surface 4 and, thus, used to angle a bottom cutting edge 25 of the blade 1 relative to the ground surface 4. The center shift cylinder 23 may be used primarily to centershift the drawbar 19, relative to the front frame 6, and thus reposition the blade 1 mounted on a circle 26.

The drawbar 19 further includes a large gear, commonly referred to as the circle 26. The circle 26 is rotated by a hydraulic motor, commonly referred to as a circle drive 27. The rotation of the circle 26 by the circle drive 27, sometimes referred to as a circle turn, rotates the blade 1 about a blade rotation axis A, also referred to as the blade cutting angle or blade rotation angle. The blade rotation angle is defined as the angle of the blade 1 relative to the drawbar 19. At a zero degree blade rotation angle, the blade 1 is aligned at a right angle with the drawbar 19, as best shown in FIG. 2.

The blade 1 is supported on the circle 26 by being mounted to a hinge 28 on the circle 26 with a bracket 29. A blade tip cylinder 30 is used to pitch the bracket forward or rearward. Thus, the blade tip cylinder 30 is used to tip a top edge 31 of the blade 1 ahead or behind the bottom cutting edge 25 of the blade 1, also referred to as the blade pitch.

The blade 1 is mounted to a sliding joint (not shown) in the bracket 29 allowing the blade 1 to be slide or shifted from side to side relative to the bracket 29 or the circle 26. This side to side shift is referred to as blade sideshift. A sideshift cylinder 32 is used to control the blade sideshift.

As best shown in FIG. 2, a right articulation cylinder 33 is mounted to the right side of the rear frame 8 and a left articulation cylinder 34 is mounted to the left side of the rear frame 8. The right and left articulation cylinders 33, 34 are used to rotate the front frame 6 about an axis B shown in FIG. 1. The axis B is referred to as the articulation axis. In FIG. 2, the work machine 1 is positioned in a neutral or zero articulation angle.

Figure 3:
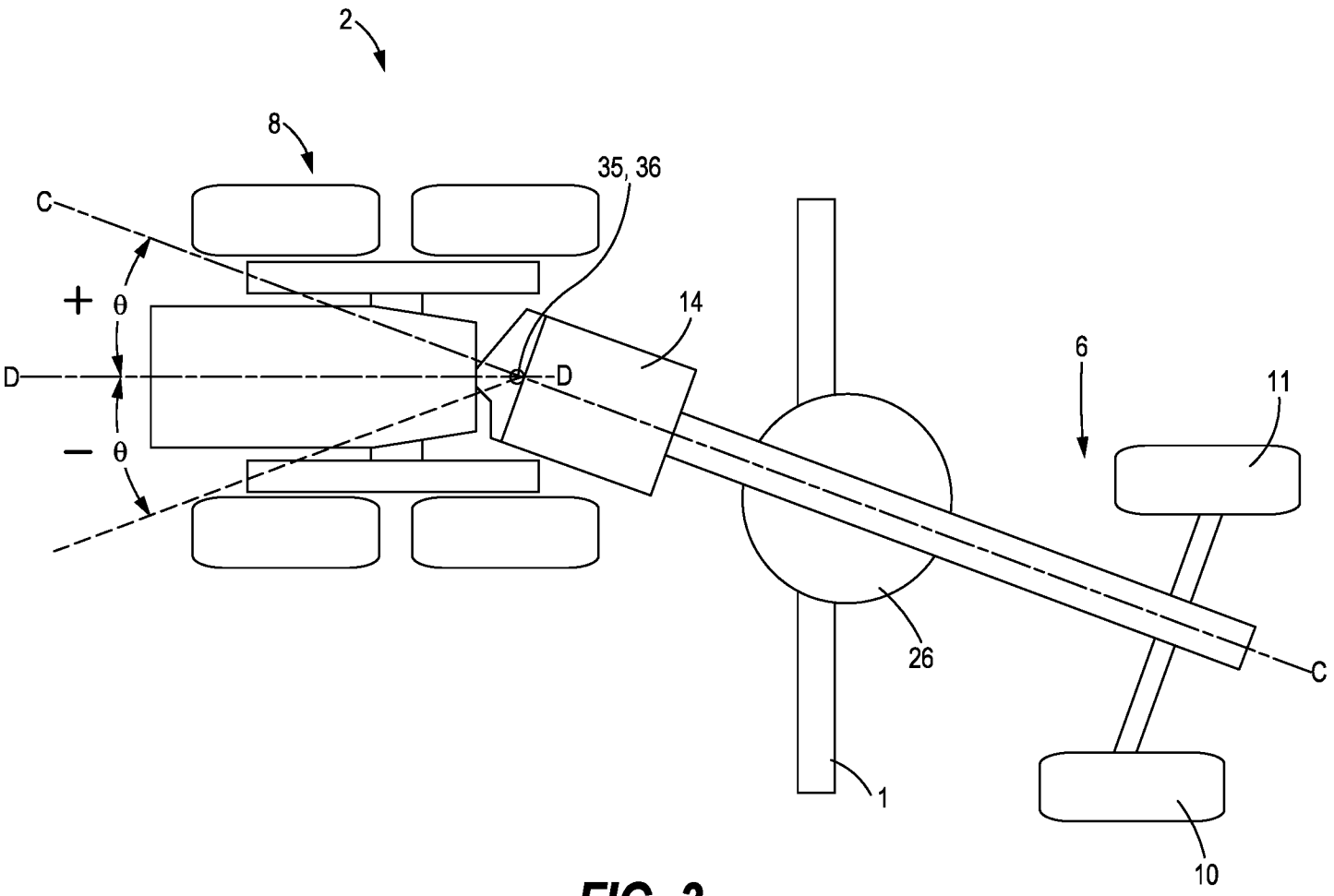
FIG. 3 is top schematic view of the work machine of FIG. 1 rotated to a full right articulation angle, in accordance with the present disclosure.

FIG. 3 is a top schematic view of the work machine 2 with the front frame 6 rotation to a full right articulation angle of +Ø. The articulation angle Ø is formed by the intersection of the longitudinal axis C of the front frame 6 and longitudinal axis D of the rear frame 8. An articulation joint 35 connects the front frame 6 and the rear frame 8. An articulation sensor 36 is used to measure the articulation angle Ø between the front frame 6 and the rear frame 8, and in one exemplary embodiment, is positioned at the articulation joint 35. A full left articulation angle −Ø, shown in phantom lines in FIG. 3, is a mirror image of the full right articulation angle +Ø, the full left articulation angle −Ø, or any angle therebetween.

Figure 4:
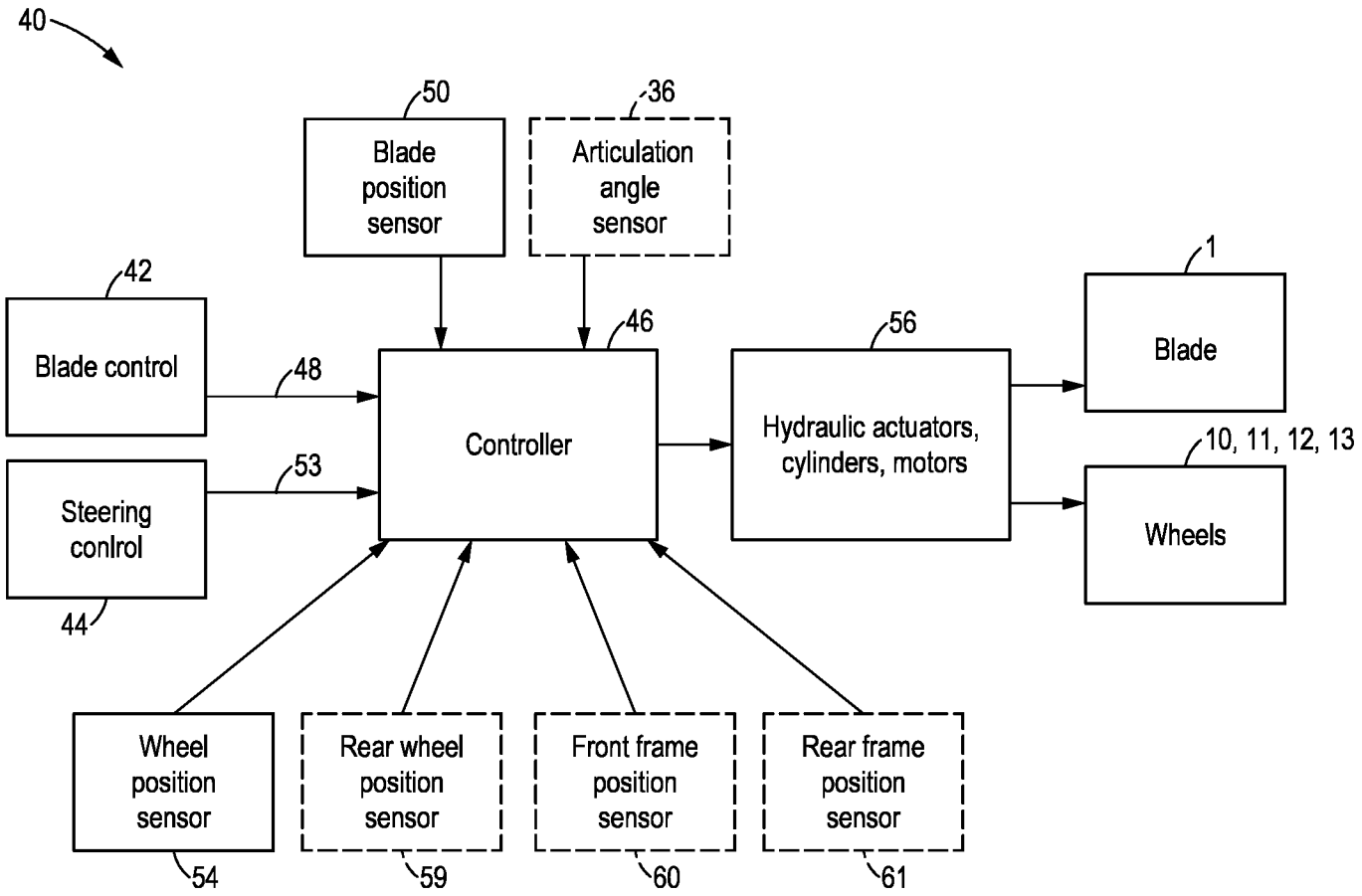
FIG. 4 is a block diagram of a control system for the work machine, in accordance with the present disclosure.

Turning to FIG. 4, is a schematic block diagram of a blade positioning system 40 for the work machine 2. The blade positioning system 40 is designed to control the blade 1 and the steering of the work machine 2, and thus, the articulation angle Ø between the front frame 6 and the rear frame 8 as the work machine 2 is steered. The system 40 includes a blade control 42, a steering control 44, and a controller 46.

The blade control 42 is used to control the positioning of the blade 1 relative to the front frame 6. The blade control 42 may be located in the operator's cab 14, and may include controls 15 to transform the action of an operator's hands into electrical signals, specifically, a blade movement signal 48, that is sent to the controller 46. The blade control 42 may further include a blade position sensor 50 which is able to determine a present blade 1 position, including blade rotation angle, blade pitch, blade height, blade oscillation angle, drawbar centershift, blade sideshift, and/or distance and orientation of the blade 1 relative to the front frame 6 or any one of, or all of, the wheels 9, 10, 12, 13.

The system 40 further includes the steering control 44 for steering the work machine 2. The steering control 44 is configured to steer the work machine 2 by repositioning the front wheels 10, 11. In one exemplary embodiment, the controls 15 may include a steering wheel 51 or joystick 52, or any other steering control found on a work machine 2, to transform the action of an operator's hands into electrical signals, specifically, a wheel movement signal 53, that is sent to the controller 46. In another exemplary embodiment, the work machine 2 uses mechanical steering, and controls through known mechanical means of steering a work machine. The steering control 44 may further include a wheel position sensor 54 which is able to determine a present wheel position. In one exemplary embodiment, the wheel position sensor 54 is placed on the front right and/or left wheel 10, 11 to track one, or both of, the front wheels, but in other embodiments, the wheel position sensor 54 is placed, in addition to or instead of, on the right and/or left tandem set of rear wheels 12, 13 to track the present location of the rear wheels. The wheel position sensor 54 can monitor the steering angle and/or degree of wheel lean of one of, or all of, the wheels 10, 11, 12, 13, and the controller 46 receives the steering angle and/or degree of wheel lean while monitoring the wheel position sensor 54. The steering sensor 54 may also measure the position of the wheels 10, 11, 12, 13 as they are repositioned.

In one exemplary embodiment, an operator of the work machine 2 is able to set a fixed position of the blade 1 relative to one of the wheels 10, 11, 12, 13, or the front frame 6. In another exemplary embodiment, the operator uses the blade control 42 to set the blade 1 to a desired location relative to the front right or left wheel 10, 11. The fixed position may be any predetermined distance or orientation of the blade 1 proximate to one of, or both of, the front wheels 10, 11, a rear wheel 12, 13, or the front frame 6. In a further exemplary embodiment, the controller 46 monitors the present position of the blade 1, based on information received from the blade position sensor 50, by monitoring a corner of the blade 55, or heal of blade, prior to any repositioning of the blade 1 to maintain a desired fixed position of the blade 1 relative to the wheel 10, 11, 12, 13. The fixed position can be manually set using the blade control 42 or include pre-set fixed positions. The pre-set fixed positions can include pre-programmed positions stored on a memory (not shown) for desired placement of the blade 1 relative to one of the wheels 10, 11, 12, 13, the front frame 6, or the articulation angle Ø between the front frame 6 and the rear frame 8.

The system further includes the controller that is able to monitor the blade position sensor 50 and the wheel position sensor 54 to determine a present position of the blade 1 and the front wheels 10, 11, and/or rear wheels 12, 13. The controller also receives the blade movement signal 48 and/or wheel movement signal 53 before actuating the hydraulics, actuator, cylinders, and motors, shown together as block 56, to move the blade 1, or front wheels 10, 11, respectively, to the operator's desired position.

The hydraulics actuators, cylinders, and motors, in on exemplary embodiment, includes the engine 16, right and left lift cylinders 22, 23, center shift cylinder 23, blade tip cylinder 30, sideshift cylinder 32, right articulation cylinder 33, left articulation cylinder 34, or any other cylinders or motors required for steering the wheels 10, 11, 12, 13 or repositioning the blade 1. In the exemplary embodiment, the controller 46 receives the blade movement signal 48 and actuates right and left lift cylinders 22, 23, center shift cylinder 23, blade tip cylinder 30, or sideshift cylinder 32 in order to adjust the blade position by adjusting the blade's 1 rotation angle, blade oscillation angle, blade pitch, blade height, drawbar centershift, or blade sideshift. Similarly, in the exemplary embodiment, the controller 46 receives the wheel movement signal 53 and actuates the right and left articulation cylinders 33, 34 in order to adjust the articulation angle Ø between the front frame 6 and the rear frame 8, as well as any steering shafts (not shown), hydraulic cylinders, or other steering means known for work machines, to adjust the wheel steering angle and/or wheel lean in order to steer the work machine 2.

Prior to the repositioning of the front wheels 10, 11, or the blade 1, upon receiving the wheel movement signal 53, or blade movement signal 48, the controller 46 calculates a future wheel position based on the received wheel movement signal 53, or a future blade 1 position based on the received blade movement signal 48. In one exemplary embodiment, the controller 46 adjust the blade's 1 position as the front wheels 10, 11 are repositioned, or steered, to maintain the fixed position of the blade 1 to the front wheels 10, 11. The blade 1 position is adjusted by adjusting the blade rotation angle, blade oscillation angle, blade pitch, blade height, drawbar centershift, or blade sideshift. In another exemplary embodiment, the front right wheel 10, or front left wheel 11, is a reference wheel, and the fixed position, with reference between the blade 1 to the reference wheel 57, is set by the operator of the work machine 2 and the set fixed position, distance, or orientation of the blade 1 is maintained as the reference wheel 57 is steered. In a further exemplary embodiment, the front frame 6 is used as the reference, and as the articulation angle Ø between the front frame 6 and the rear frame 8 is adjusted by steering the work machine 2, the blade 1 is repositioned by the controller 46 maintain the fixed position of the blade 1 relative to the front frame 1. In an even further exemplary embodiment, prior to the adjustment of the blade 1 position, a desired position of the blade 1 is calculated by the controller 46, the desired position being the fixed position 1 of the blade relative to the wheel 10, 11, 12, 13.

The blade positioning system 40 may include a second reference wheel 58, the second reference wheel 58 being one of the rear wheels 12, 13. The steering control 44 can further include a rear wheels position sensor 59, and the controller 46 can monitor the rear wheels position sensor 59 to determine a present location of the rear wheels 12, 13, and the controller 46 producing an action to prevent the intersection of the blade 1 with the rear wheels 12, 13 when the blade's 1 position is readjusted. This action includes adjusting the blade's 1 rotation angle, blade oscillation angle, blade pitch, blade height, drawbar centershift, or blade sideshift.

The steering control 44 can further include a front frame and rear frame position sensors 60, 61, in addition to or instead of the articulation sensor 36, to calculate the articulation angle Ø between the front frame 6 and the rear frame 6 during the steering of the work machine 2. The controller 46 can produce an action to prevent the intersection of the blade 1 with the rear or front frame 6, 8 based on the articulation angle Ø when the blade's 1 position is being adjusted. This action includes adjusting the blade's 1 rotation angle, blade oscillation angle, blade pitch, blade height, drawbar centershift, or blade sideshift The blade positioning system 40 can function with other systems of a work machine 2, such as any automated grade control systems (not shown) that are designed to control cross slope by automating blade movements on one side of the blade 1.

In a further exemplary embodiment, a work machine 2 having a mechanical steering control 44 is used. In this embodiment, the wheel position sensor 54 measures the position of one of the front wheels 10, 11 as it is mechanically repositioned, or steered. After the blade control 42 is used to place the blade in the fixed position, detailed above, the controller 46 monitors the blade 1 position sensor and the wheel position sensor to determine a present position of the blade and the wheel, and adjust the blade 1 to the fixed position as the front wheel 10, 11 is repositioned based on the measured position of the wheel 10, 11.

INDUSTRIAL APPLICABILITY

In general, the teachings of the present disclosure may find applicability in many industries including, but not limited to, motor graders. More specifically, the teachings of the present disclosure may find applicability in any industry using blades, or moldboards, in a grading operation, such as, but not limit to, construction, excavating, agriculture, and the like.

In accordance with the scope of the present disclosure, in one such operation it is desirable to place the leading edge of the blade behind a front wheel, and often, it is desired to get the blade as close as possible to the front wheel in order to obtain the most desirable grade cut. In order to prevent damage to the wheel, the present disclosure provides a method for autonomously adjusting the blade position as the wheels are steered.

Figure 5:
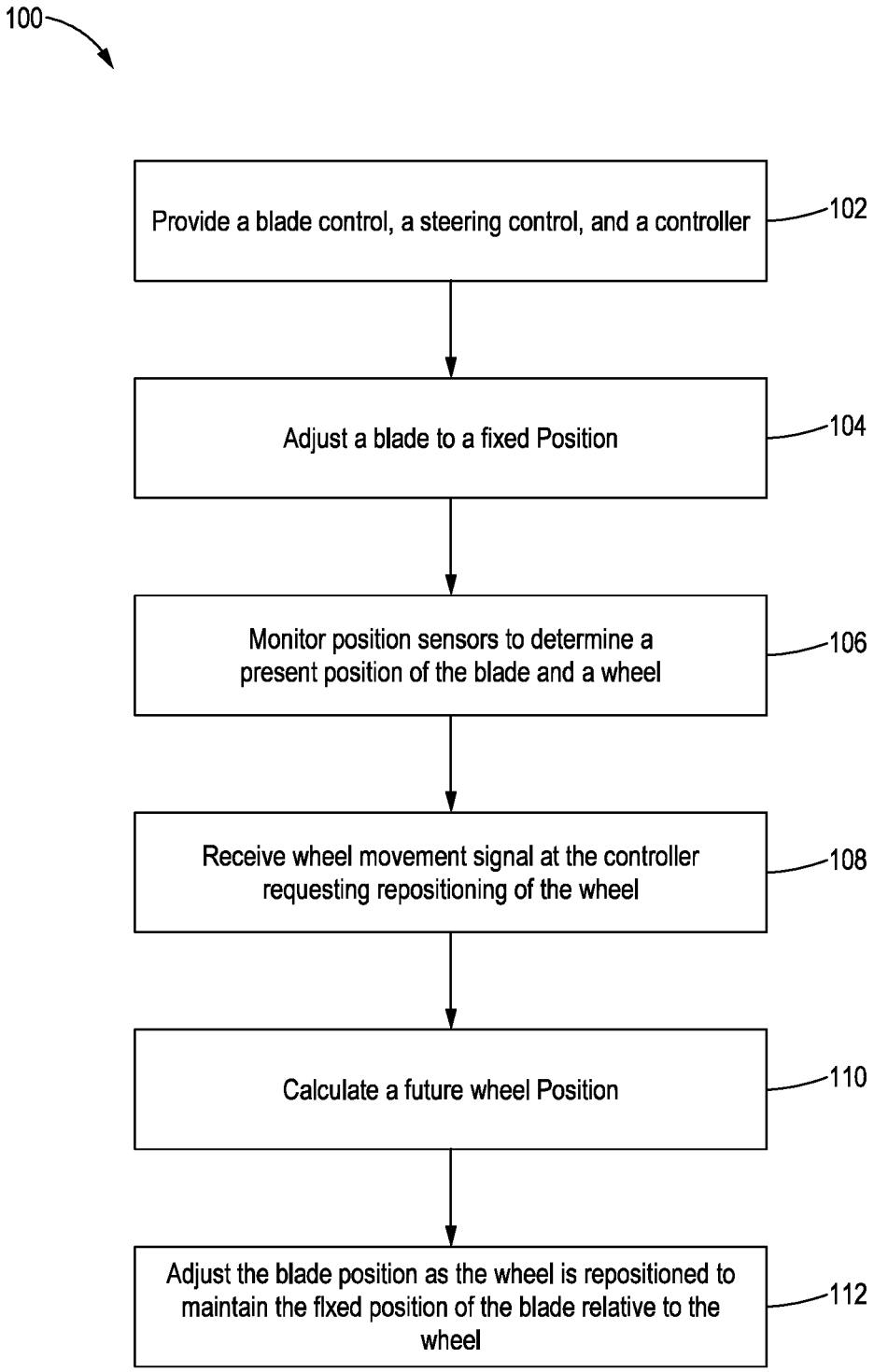
FIG. 5 is a flow chart illustrating an autonomous method of work machine operation where the blade is automatically maintained at a predetermined position proximate to one of the wheels of a motor grader.

Turning now to FIG. 5, with continued reference to FIGS. 1-4, a flowchart illustrating an exemplary method 100 for autonomously repositioning a blade 1 of a work machine 2 relative a wheel 10, 11 is shown. At block 102, a blade control 42 having a blade position sensor 50, a steering control 44 having a wheel position sensor 54, and a controller 46 are provided. The steering control 44 steers the work machine 2 by sending a wheel movement signal 53 to the controller 46, and the controller 46 can reposition the wheel 10, 11 using the hydraulics, actuators, cylinders, or motors 56.

At block 104, the blade 1 is adjusted using the blade control 42 to a fixed position relative to the wheel 10, 11. The wheel position sensor 54 and the blade position sensor 50 are monitored by the controller 46 at block 106 to ascertain a present position of the blade 1 and the wheel 10, 11. The wheel movement signal 53 is then received at the controller 46 at block 108 requesting repositioning of the wheel 10, 11 prior to the controller 46 calculating a future wheel 10, 11 position at block 110 based on the received wheel movement signal 53.

In order to maintain the fixed position of the blade 1 relative to the wheel 10, 11, the controller 46 adjust the blade 1 position as the wheel 10, 11 is repositioned at block 112. The blade 1 position is adjusted by adjusting the blade rotation angle, blade oscillation angle, blade pitch, blade height, drawbar centershift, or blade sideshift.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A blade positioning system for maintaining the position of a blade of a work machine to a wheel of the work machine, the blade positioning system comprising:

a blade control including a blade position sensor, the blade control configured to adjust the blade to a fixed position relative to the wheel; and a steering control including a wheel position sensor and a controller, the steering control is configured to steer the work machine by repositioning the wheel, and the controller is configured to monitor the blade position sensor and the wheel position sensor to determine a present position of the blade and the wheel prior to the repositioning of the wheel, and adjust the blade position as the wheel is repositioned to maintain the fixed position of the blade relative to the wheel.

2. The blade positioning system of claim 1, wherein the wheel position sensor measures the position of the wheel as it is repositioned, and the controller adjust the blade position based on the measured position of the wheel to maintain the fixed position.

3. The blade positioning system of claim 1, wherein the wheel is the right or left front wheel of the work machine, the steering control is further configured to steer the work machine by sending a wheel movement signal to the controller, the controller further configured to calculate a future wheel position based on the received wheel movement signal and to reposition the wheel based on the received wheel movement signal.

4. The blade positioning system of claim 3, wherein the blade position is adjusted by adjusting the blade rotation angle, blade oscillation angle, blade pitch, blade height, drawbar centershift, or blade sideshift.

5. The blade positioning system of claim 3, wherein before the blade position is adjusted, a desired position of the blade is calculated by the controller, the desired position being the fixed position of the blade relative to the wheel.

6. The blade positioning system of claim 3, wherein the controller monitors the present position of the blade by monitoring a corner of the blade, and the blade position is adjusted to maintain the fixed position of the corner of the blade with the wheel.

7. The blade positioning system of claim 3, wherein the wheel position sensor is configured to monitor the steering angle of the wheel, and the controller receives the steering angle while monitoring the wheel position sensor.

8. The blade positioning system of claim 3, wherein the fixed position is a predetermined fixed position, distance, or orientation proximate to the wheel.

9. The blade positioning system of claim 8, wherein the fixed position is manually set using the blade control to position the blade or the blade control includes pre-set fixed positions.

10. The blade positioning system of claim 9, wherein the pre-set fixed positions includes desired position of the blade relative to the wheel.

11. The blade positioning system of claim 3, wherein the blade positioning system functions with automated grade control systems of the work machine.

12. A work machine, comprising:

a rear frame supported on a right and left tandem set of rear wheels;

a front frame supported on a pair of front wheels;

a steering control including a front wheels position sensor and a controller, the steering control is configured to steer the work machine by sending a front wheels movement signal to the controller, and the controller configured to reposition the front wheels;

a circle connected to the front frame by a drawbar, the circle supporting a blade;

a blade control including a blade position sensor, the blade control configured to adjust the blade to a fixed position relative to a reference wheel, the reference wheel being one of the front wheels, and the controller is configured to monitor the blade position sensor and the front wheels position sensor to determine a present position of the blade and the reference wheel prior to the repositioning of the front wheels, calculate a future reference wheel position based on the received front wheel movement signal, and adjust the blade position as the front wheels are repositioned to maintain the fixed position of the blade relative to the reference wheel.

13. The work machine of claim 12, wherein the work machine further includes a second reference wheel.

14. The work machine of claim 13, wherein the second reference wheel is one of the rear wheels, and the steering control further includes a rear wheels position sensor, the controller is further configured to monitor the rear wheels position sensor to determine a present location of the rear wheels, and the controller producing an action to prevent the intersection of the blade with the rear wheels when the blade position is adjusted.

15. The work machine of claim 12, wherein the steering control further includes articulation sensor configured to calculate an articulation angle between the front frame and the rear frame during the steering of the work machine.

16. The work machine of claim 15, wherein the controller is further configured to produce an action prevent the intersection of the blade with the rear or front frame based on the articulation angle when the blade position is being adjusted.

17. A method for autonomously repositioning a blade of a work machine relative to a wheel, the method comprising the steps of:

providing a blade control having a blade position sensor, a steering control having a wheel position sensor, and a controller, the steering control configured to steer the work machine by sending a wheel movement signal to the controller, and the controller configured to reposition the wheel;

adjusting the blade using the blade control to a fixed position relative to the wheel;

monitoring an output of the position sensors to ascertain a present position of the blade and the wheel;

receiving the wheel movement signal at the controller requesting repositioning of the wheel;

calculating a future wheel position based on the received wheel movement signal; and adjusting the blade position as the wheel is repositioned to maintain the fixed position of the blade relative to the wheel.

18. The method of claim 17, wherein the wheel is the front right or front left wheel.

19. The method of claim 17, wherein the blade is adjusted to the fixed position relative to the wheel using a pre-set configuration stored on a memory.

20. The method of claim 17, wherein the wheel is repositioned to maintain the fixed position of the heal of the blade relative to the wheel.

* * * * *